United States Patent [19]

Lautenschläger, Jr.

[11] Patent Number: 4,718,143

[45] Date of Patent: Jan. 12, 1988

[54] MOUNTING PLATE FOR CABINET HINGES

[75] Inventor: Karl Lautenschläger, Jr., Reinheim, Fed. Rep. of Germany

[73] Assignee: Karl Lautenschläger KG. Möbelbeschlagrabrik, Reinheim, Fed. Rep. of Germany

[21] Appl. No.: 817,110

[22] Filed: Jan. 8, 1986

[30] Foreign Application Priority Data

Jan. 15, 1985 [DE] Fed. Rep. of Germany ..... 3501048

[51] Int. Cl.[4] ..... E05D 7/04

[52] U.S. Cl. ..... 16/238; 16/382

[58] Field of Search ..... 16/235–238, 16/242, 245, 246, 252, 253, 382–384, DIG. 22, DIG. 43

[56] References Cited

U.S. PATENT DOCUMENTS

| | | | |
|---|---|---|---|
| 2,990,570 | 7/1961 | Gilpatrick | 16/DIG. 43 |
| 3,711,893 | 1/1973 | King | 16/383 |
| 3,977,042 | 8/1976 | Lautenschlager | 16/238 |
| 4,131,969 | 1/1979 | Suska | 16/388 |
| 4,142,271 | 3/1979 | Busse | 16/238 |
| 4,359,802 | 11/1982 | Rock | 16/238 |
| 4,367,566 | 1/1983 | Rock et al. | 16/236 |
| 4,615,072 | 10/1986 | Lautenschlager | 16/238 |

FOREIGN PATENT DOCUMENTS

| | | | |
|---|---|---|---|
| 197808 | 8/1928 | Fed. Rep. of Germany | 16/DIG. 43 |
| 698648 | 11/1965 | Italy | 16/235 |

*Primary Examiner*—Paul A. Bell
*Assistant Examiner*—James L. Wolfe

[57] ABSTRACT

In an adjustable-height mounting plate for cabinet hinges, the mounting plate has a bottom part which can be fastened directly to a cabinet wall, and a top part provided with means for fastening the supporting arm of a cabinet hinge, the top part being mounted on the bottom part through the medium of interfitted guide means for displacement parallel to the hinge pivot axis and for locking at any desired point. When in the superimposed state, each part has an elongated central section from each of whose opposite sides a wing-like projection extends. In one of the wings of the top part there is provided a slot running in the direction of displacement, through which a clamping screw passes when it is driven into a tap in the bottom part to clamp the two parts together. In the other wing of the top or bottom part there is provided a second slot running in the direction of displacement, which is engaged by a short shaft-like projection protruding from the bottom part or top part, as the case may be, on whose free end there is provided a holding head laterally overlapping the margins of the slot with slight clearance, which prevents unintentional separation of the top part from the bottom part.

13 Claims, 13 Drawing Figures

Fig. 4
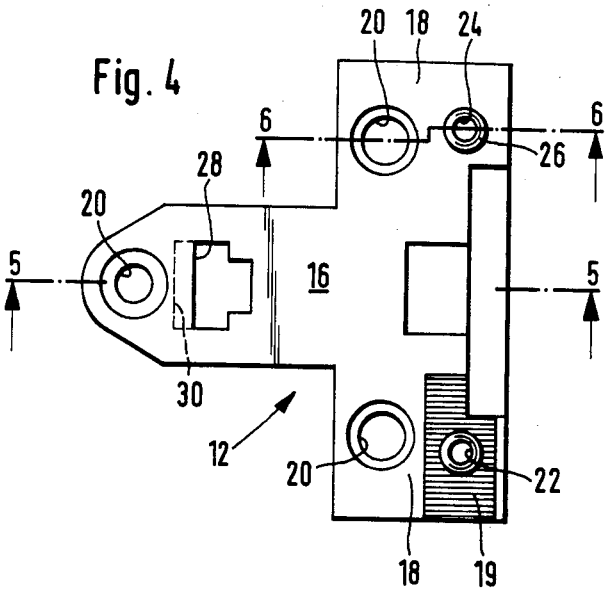
Fig. 5
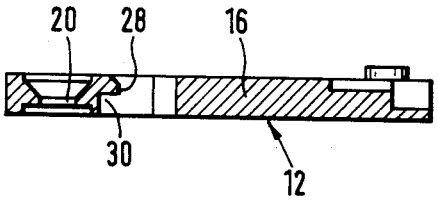
Fig. 6
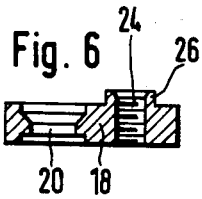
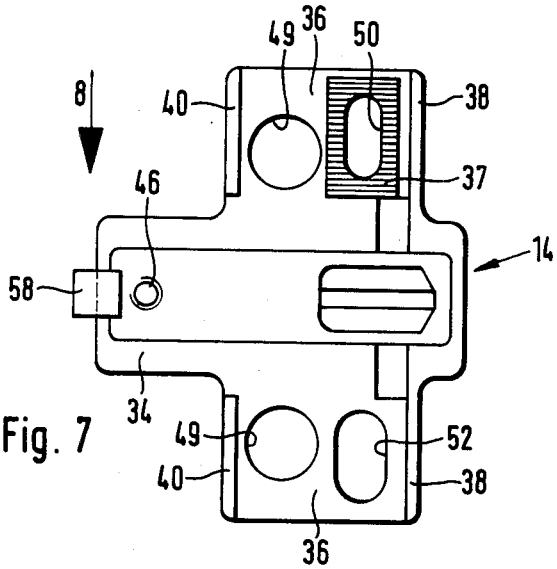
Fig. 7

Fig. 8
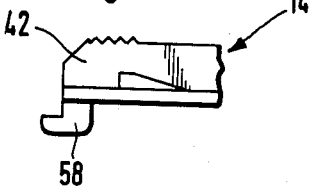
Fig. 9
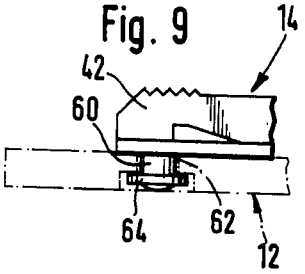
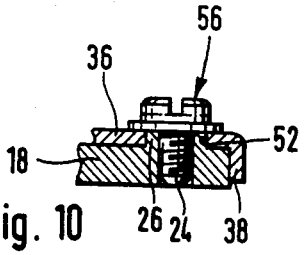
Fig. 10
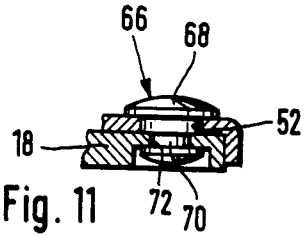
Fig. 11
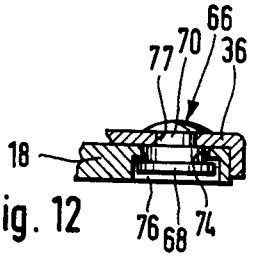
Fig. 12
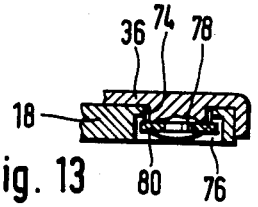
Fig. 13

MOUNTING PLATE FOR CABINET HINGES

BACKGROUND OF THE INVENTION

The invention relates to a mounting plate for the adjustable fastening of the supporting-wall-related part of a cabinet hinge, in the form of a supporting arm, to a cabinet carcase. Such a mounting plate has a bottom part for fastening directly to the supporting wall, and a top part which is provided with means for fastening the supporting arm and is mounted on this bottom part through mating guide means so as to be displaceable and selectively fixable parallel to the hinge pivot axis. Each part has an oblong central section from each of whose opposite long sides there extends a wing-like projection, and in one of the wings of the upper part there is provided a slot running in the direction of displacement, through which the shaft of a clamping screw is driven into a tap in the bottom part.

Bipartite mounting plates designed for height adjustment, for the adjustable mounting of cabinet hinges with a supporting wall-related part in the form of an elongated supporting arm are known (German published application No. OS 20 43 622), in which an elongated bottom part can be fastened by screws to the door-supporting wall of a cabinet carcase, and the top part, which is guided by interfitting tongues and grooves on the bottom part, can be locked on the bottom part by at least one separate clamping screw. On the other hand, mounting plates are known having wing-like projections —so-called "wings"—extending from the opposite sides of an oblong middle section, in which mounting bores are provided, so that such "wings" can be fastened in bores provided at a vertical distance apart from one another, e.g., in bores in a front row of bores basically intended for the accommodation of shelf supports. Such wing plates have already been constructed as bipartite, adjustable-height mounting plates (German published application No. OS 26 24 453), in which the height adjustment is made possible by slots provided in the wings of the upper part, through which the shafts of the mounting screws are driven into the associated mounting bores in the supporting wall. When the mounting screws are loosened, the top part is then adjustable for height within the range provided by the slots. Unless the mounting screws are loosened, no height adjustment is possible in the case of a wing plate of the kind mentioned above (German published application No. OS 30 22 440) in which the wall-mounting is accomplished by a mounting screw driven through each of associated bores in the wings of the bottom part.

For the height-adjustment, the top part is shifted on the bottom part with the clamping screw loosened, i.e., the mounting screws holding the mounting plate on the supporting wall do not have to be loosened. To assure that, when the height is being adjusted, the top part will not accidentally separate from the bottom part allowing the hinge attached to the upper part to fall together with the door attached, which is possible if the clamping screw is backed off only a little too far, not only is the top part guided on the bottom part in the direction of displacement, but also it hooks under it in the area of the lateral margins running in the height-adjustment direction on the wings, so that a positive security is provided against separation of the top part from the bottom part. In this configuration, however, undercut grooves are formed along the edges of the wings, and, when the top part is made from die-cast metal, these necessitate casting dies provided with sliders, which are complex and accordingly expensive.

Accordingly, the invention is addressed to the problem of improving the known wing plate such that, while working in basically the same manner and with the same reliability, it will be substantially simpler and thus less expensive to manufacture.

SUMMARY OF THE INVENTION

Setting out from a mounting plate of the kind mentioned in the beginning, this problem is solved according to the invention in that, in the wing-like projections of the top and bottom parts provided with the slots accommodating the shaft of the clamping screw, an additional slot running in the direction of displacement is provided, in which a short, shaft-like projection protruding from the bottom part or top part, as the case may be, is engaged, on whose free end there is provided a holding head overlapping the lateral margins of the slot with a slight axial clearance. The separation of the top part from the bottom part is therefore prevented by the holding head overlapping the second slot, thus eliminating the necessity of forming undercut grooves in the top part.

The second slot in this case can be provided in the associated wing of the top part, and the holding head provided on the end of the projection protruding from the bottom part is then exposed on the upper side of the wing of the top part and thus provides optical symmetry with the head of the clamping screw provided on the other wing.

The projection in this case can extend integrally from the wing and can be provided with a tap into which the threaded shaft of a holding screw is driven, whose head then forms the holding head. By establishing the height of the projection such that, when the holding screw is driven fully into the tap, the surface of its head confronting the top part will have the required axial clearance from the upper surface of the top part, the need for clamping the top part on the bottom part by means of the holding screw is eliminated, i.e., the holding screw does not have to be loosened for height-adjustment purposes.

The projection can also be formed by the shaft of a headed pin, whose headless end is fastened in the bottom part. It is then recommendable to provide on the headless end of the headed pin a shaft section of a diameter smaller than the shaft section passing through the slot. The step thus formed between the two shaft sections then assures that the head of the headed pin will be held at the necessary, nonclamping distance from the upper side of the bottom part.

The end section of reduced diameter on the headed pin can best be passed through a bore of corresponding diameter in the bottom part, with its free end riveted in a recess counterbored into the bottom of the bottom part. Instead of a threaded junction, which is of course possible, this will provide a permanent joining of the headed pin to the bottom part and thus a permanent joining of the bottom part to the top part.

The second slot can also be provided in the associated wing of the bottom part, in which case the holding head provided on the end of the projection protruding from the bottom of the top part will be situated in a recess surrounding the slot on the bottom of the bottom part. In a cinematic reversal of the embodiment described above, a holding screw can then again be driven from the bottom of the bottom part into a tap in the projection. Since, when this holding screw is loosened, however, an installed mounting plate would have to be released from its foundation in order to be able to retighten the holding screw, the holding head is preferably in the form of a rivet head formed by the plastic deformation of the free end of the projection.

The projection can then best have on its holding-head end a section of reduced diameter on which a disk overlapping the lateral margins of the slot is placed, the disk being held in turn by the rivet head.

The projection, in the simplest case, is formed integrally on the bottom of the wing of the top part. For this, however, it is necessary that the material of the top part be sufficiently plastically deformable so as to permit the forming of the rivet head on the free end of the projection.

Alternatively, the projection can also be a pin provided preferably with an integral holding head and held in a bore in the top part.

The pin then has at its top-part end an end section of a diameter smaller than the shaft diameter, which is fitted through the bore in the upper part, and whose free end is riveted onto the top side of the top part. The rivet head then again constitutes an optical counterbalance for the head of the clamping screw which is visible on the other wing.

Additional guidance and retention of the top part on the bottom part can be achieved by providing on the end of the oblong central section pointing into the carcase interior a a catch engaged in an elongated opening in the bottom part which runs in the direction of displacement, and hooking laterally under at least one longitudinal margin of the opening. The opening is then undercut on the bottom of the bottom part at least in the portion of the longitudinal margin engaged by the catch, so as to permit full-area contact between the bottom of the bottom part and the supporting wall.

BRIEF DESCRIPTION OF THE DRAWING

The invention will be further explained in the following description of several embodiments, in conjunction with the drawing, wherein:

FIG. 4 is a top view of the bottom part of the mounting plate shown in FIGS. 1 to 3, FIG. 5 is a sectional view seen in the direction of the arrows 5—5 in FIG. 4, FIG. 6 is a sectional view seen in the direction of the arrows 6—6 in FIG. 4, FIG. 7 is a bottom view of the top part of the mounting plate shown in FIGS. 1 to 3, FIG. 8 is a detail of the top part as seen in the direction of the arrow 8 in FIG. 7, FIG. 9 is an alternative embodiment of the detail shown in FIG. 8, FIG. 10 is a partial cross section as seen in the direction of the arrows 10—10 in FIG. 2, FIG. 11 is a partial cross section corresponding to the one in FIG. 10, taken through a variant of the mounting plate, FIG. 12 is another partial cross section corresponding to those of FIGS. 10 and 11, taken through another variant embodiment, and FIG. 13 is again a partial cross section corresponding to those of FIGS. 10 to 12, taken through another variant embodiment.

DETAILED DESCRIPTION OF PREFERRED EMBODIMENTS

Figure 1:
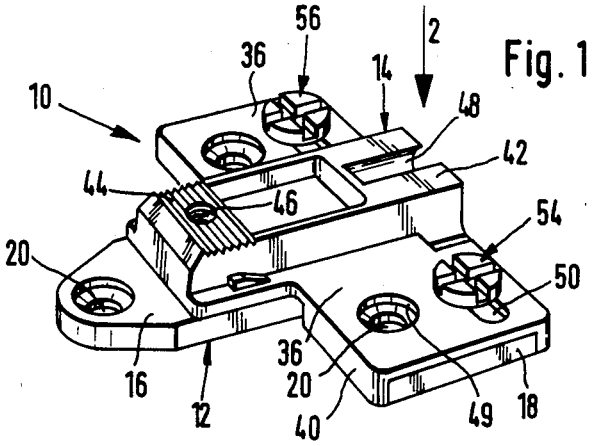
FIG. 1 is a perspective view of an adjustable-height mounting plate according to the invention, in the form of a wing plate.
Figure 2:
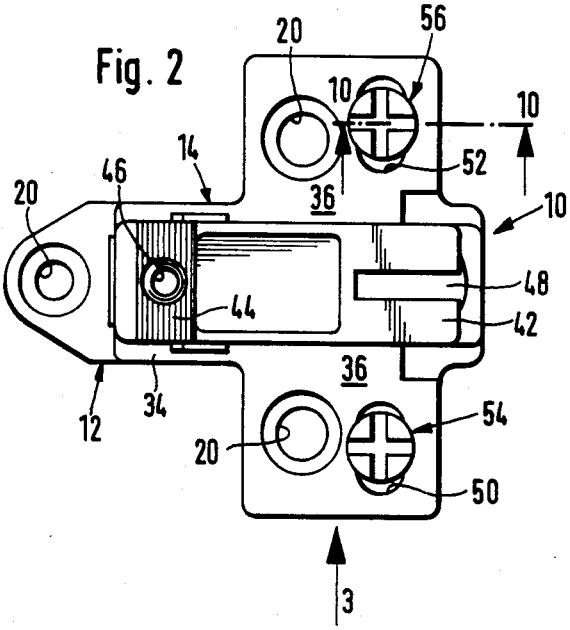
FIG. 2 is a top plan view of the mounting plate, as seen in the direction of arrow 2 in FIG. 1.
Figure 3:
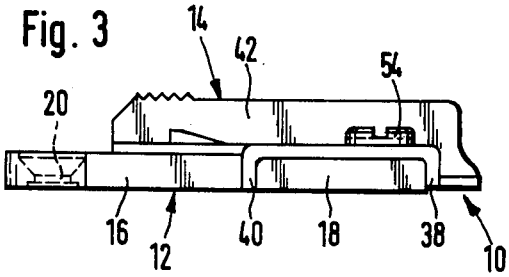
FIG. 3 is a side elevational view of the mounting plate as seen in the direction of arrow 3 in FIG. 2.

The mounting plate shown in FIGS. 1 to 3 and generally designated by the number 10 is composed of a bottom part 12 which can be fastened directly to the supporting wall of a cabinet carcase, and of a top part 14 which is displaceable within a given range on the bottom part and can be locked at selected points in that range. In the case illustrated, both these parts can be made from metal by the pressure-casting process from zinc die-casting alloy (Zamak), although they might also be made by stamping from sheet metal, or, especially in the case of the bottom part 12, they might be made by injection molding from plastic. The bottom part 12 and the top part 14 are shown separately in FIGS. 4 to 6, and 7, respectively.

The flat bottom part 12 with its substantially planar top side is in the shape of a T in plan (FIG. 4), being composed of an elongated middle section 16 and two wing-like projections 18 projecting from the opposite longitudinal sides of the middle section. In the free end of the middle section 16 and in each of the wings 18 there is provided a countersunk mounting bore 20. When the mounting plate is fastened to the supporting wall of a cabinet carcase, mounting screws (not shown) are driven through these mounting bores into the supporting wall, thereby firmly fastening the bottom part 12 on the wall. In each of the wings 18 there is furthermore provided a tap 22 and 24, respectively, of which tap 24 lies within a cylindrical collar 26 rising above the upper surface of the wing 18. In the middle section 16, in the vicinity of the mounting bore 20 there is also provided an elongated opening 28 which runs substantially parallel to the wings 18, and which has an undercut on the bottom at 30 along its edge adjacent the mounting bore 20.

The top part 14, which can be superimposed on the bottom part, also has a T-shaped configuration in plan, with an elongated middle section 34 and two wing-like projections 36 extending in opposite direction from its longitudinal edges. The middle section 34 is slightly shorter than the middle section 16 of the bottom part, so that the free end of the middle section 16 and thus the mounting bore 20 is accessible when the top part 14 is placed on the bottom part 12. The wings 36 overlie the wings 18 of the bottom part and have along their lateral longitudinal margins the guiding flanges 38 and 40 bent down toward the bottom part 12 and engaging between them the corresponding longitudinal edges of the wings 18, so that they thus form guide means permitting the top part 14 to be displaced on bottom part 12 only at right angles to the length of the middle sections 16 and 34, i.e., in the desired height-adjustment direction. The guiding flanges 40 extend from the free end of the wings 36 only so far in the direction of the middle section 34 that the desired maximum amount of displacement is given before their confronting edges engage the lateral edges of the middle section 16 of the bottom part 12.

From the upper side of the middle section 34 of upper part 14 facing away from the bottom part 12 rises an oblong platform 42 on which the supporting arm of a hinge can be adjustably fastened. For this purpose, the fastening means commonly used for the mounting of hinge supporting arms are provided on the platform 42, these fastening means being formed in the present case by a tap 46 provided in the rear end area and opening within a surface 44 provided with transverse serrations, and by an open-ended, narrow-mouthed slot 48 in the front end area, such as the one described in detail in German published application No. 33 02 312. These fastening means can of course be modified for adaptation to the supporting-arm configuration of different types of hinges, i.e., the tap 46 and the slot 48 are to be understood, in the scope of the present invention, only as possible, exemplary configurations of the fastening means, which can be modified if necessary.

In the wings 36, circular openings 49 are provided which, when the two parts 12 and 14 of the mounting plate are in the aligned central or starting position, are aligned with the mounting bores 20 in the wings 18, and permit mounting screws to be driven in the mounting bores 20 without having to remove the top part 14 from the bottom part 12.

Furthermore, slots 50 and 52 are provided one in each wing 36, running in the direction of displacement, through which a friction locking screw 54 and a holding screw 56, respectively, can be driven into the taps 22 and 24, respectively. The slot 52 has such a width that the cylindrical collar 26 surrounding the tap 24 can enter slot 52 with clearance, its depth being slightly greater than the thickness of the wing 36. Between the top side of the wing 36 and the bottom of the head of the holding screw 56, when it is driven downwardly into contact with the top face of the collar 26, there is therefore a slight axial play, so that the head of holding screw 56 radially overlapping the collar 26 (or a washer placed under it) will prevent the top part 14 from lifting away from the bottom part, but will permit their displacement relative to one another. On the other hand, the tightening of the friction locking screw 54 will cause its head to press the top part 14 onto the lower part 12 and thus the two parts are able to be fixed—after first loosening the friction locking screw 54—in a selected position relative to one another. By means of appropriate roughening or serrations running transversely of the direction of displacement (37 and 19 in FIGS. 7 and 4, respectively) and provided on the surfaces of the top and bottom parts, when they are pressed together by the tightening of the friction locking screw 54, it is possible to achieve an additional positive retention of the selected height adjustment over and above the purely frictional retention.

An additional securing of the top part 14 against lifting away from the bottom part 12 is achieved by a downwardly projecting catch 58 (FIGS. 7 and 8) provided on the rear end, i.e., the end pointing toward the cabinet interior, of the middle section 34. The catch 58 is introduced into the opening 28 in the bottom part 12 such that its hook engages the undercut 30 and thus—in addition to the holding screw 56—secures the top part against lifting away from the bottom part. On the other hand, however, the top part 14 is also removable from the bottom part when desired, if first the holding screw 56 is removed from the tap 24 and the upper part is then raised at its front end to such an extent that the hook of the catch 58 is drawn forward from under the undercut 30 and the top part can then be lifted off.

If it is desired to prevent any separation of the top part 14 from the bottom part 12 after its first installation, this can be accomplished by providing, instead of the catch 58, a stud 60 (FIG. 9) projecting from the bottom of the middle section 34, which is guided by a transversely disposed slot 62 cut in the bottom of the bottom part 12 and has a washer 64 riveted onto its free end. Then, instead of the holding screw 56, a headed pin 66 fastened unremovably in the bottom part (FIG. 11) can be used, whose shaft is closely fitted through the slot 52, while its upset head 68 laterally overlaps the slot, like the head of the holding screw 56. The unremovable fastening of the headed pin 66 in the bottom part is then best accomplished by mushrooming a shaft end section 70 of reduced diameter in a bore of corresponding diameter 72 bored from the bottom side of the wing 18.

In FIG. 12 there is shown a variant of the method described above in conjunction with FIG. 11, of joining together the wings 18 and 36 so as to be inseparable but allow displacements. The slot 74, without which no displacement at all would be possible, is in this case formed, not in the wing 36 in the top part but in the wing 18 of the bottom part, and has a counterbore 76 drilled in the bottom of the bottom part 12. The headed pin corresponding to the headed pin 66 is therefore passed through the slot 74 with its head 68 recessed in the counterbore 76, while its free end section 70 of reduced diameter passes through a bore 77 of corresponding diameter in the wing 36, and riveted in place by mushrooming the protruding end against the top side of the wing 36.

FIG. 13 shows another variant of the joining method represented in FIG. 12. The slot 74 with counterbore 76 is disposed, as in the preceding embodiment, in the wing 18 of the bottom part. The headed pin, however, is constituted by a cylindrical projection 78 which passes through the slot and on whose free end is riveted a washer 80 situated in the counterbore 76 and laterally reaching under the margins of the slot 74.

I claim:

1. A mounting plate for the adjustable fastening of a supporting wall-related part of a cabinet hinge on a cabinet carcase, said mounting plate comprising: a bottom part to be attached to a carcase supporting wall, and a top part having fastening means for the supporting wall-related part, guide means on said top and bottom parts for displaceably and selectively lockably mounting said top part on said bottom part, said top and bottom parts each having an elongated middle section with two opposite longitudinal sides, two wings respectively extending from said sides of said middle sections, a first slot running in the direction of displacement of the hinge in one of said wings of said top part, a threaded shaft of a clamping screw being passable through said first slot into a tap in said bottom part, a second slot in the other wing of said top part opposite said one wing provided with said first slot, said second slot running in the direction of displacement of the hinge; a relatively short, shaft-like projection protruding from said bottom part, and a holding head on said projection and laterally over-reaching margins of the second slot with a slight axial clearance and lying free on an upper side of said one wing of said top part, said elongated middle section of the top part having an end pointing into the carcase interior, said top part end having a holding projection which enters into an elongated opening extending in the direction of displacement, in the middle section of the bottom part, and laterally underreaches at least one longitudinal margin of the elongated opening to thereby secure the top part from being lifted off the bottom part in any relative position of said two parts.

2. A mounting plate according to claim 1, wherein the projection projects integrally from the wing of the bottom part and is provided with a tap into which is driven a shaft of a holding screw having a head forming said holding head.

3. A mounting plate according to claim 1, wherein the projection is formed by a shaft of a headed pin having a free end facing away from the head and fastened in the wing of the bottom part.

4. A mounting plate according to claim 3, wherein the free end has a diameter reduced in comparison to the projection passing through the second slot.

5. A mounting plate according to claim 4, wherein the reduced-diameter free end reaches through a bore of corresponding size in the bottom part and the free end is riveted in a counterbore in an underside of the bottom part.

6. A mounting plate according to claim 1, wherein said elongated opening is recessed at least in the longitudinal margin on an underside of the bottom part underreached by the holding projection.

7. A mounting plate according to claim 1, comprising roughening or serrations in confronting faces of the bottom part and top part.

8. A mounting plate for the adjustable fastening of a supporting wall-related part of a cabinet hinge on a cabinet carcase, said mounting plate comprising: a bottom part to be attached to a carcase supporting wall, and a top part having fastening means for the supporting wall-related part, guide means on said top and bottom parts for displaceably and selectively lockably mounting said top part on said bottom part, said top and bottom parts each having an elongated middle section with two opposite longitudinal sides, two wings respectively extending from said sides of said middle sections, a first slot running in the direction of displacement of the hinge, in one of said wings of said top part, a threaded shaft of a clamping screw being passble through said first slot into a tap in said bottom part, a second slot in the other wing of said bottom part opposite said one wing provided with said first slot, said second slot running in the direction of displacement of the hinge; a relatively short, shaft-like projection protruding from said top part, and a holding head on said projection and laterally over-reaching margins of the second slot with a slight axial clearance, and lying in a recess surrounding said second slot, said elongated middle section of the top part having an end pointing into the carcase interior, said top part end having a holding projection which enters into an elongated opening extending in the direction of displacemet, in the middle section of the bottom part, and laterally underreaches at least one longitudinal margin of the elongated opening to thereby secure the top part from being lifted off the bottom part in any relative position of said two parts.

9. A mounting plate according to claim 8, wherein said holding head has a rivet head formed by plastic deformation of the free end of the projection.

10. A mounting plate according to claim 9, wherein the projection has on its holding-head end a section of reduced diameter, a disk overlapping the lateral margins of the second slot being set on said end, said end being held by the rivet head.

11. A mounting plate according to claim 8, wherein the projection is formed integrally on the bottom of the wing of the top part.

12. A mounting plate according to claim 8, wherein the projection is a pin held in a bore in the top part.

13. A mounting plate according to claim 12, wherein the pin has a top part end with an end section of a diameter smaller than the shaft diameter, which passes fittedly through the bore in the top part, and whose free end is riveted on a top side of the top part.

* * * * *